United States Patent [19]

Levin

[11] 4,286,358

[45] Sep. 1, 1981

[54] PAPER CLIP

[76] Inventor: Gary M. Levin, 940 E. 19 St., Brooklyn, N.Y. 11230

[21] Appl. No.: 100,445

[22] Filed: Dec. 5, 1979

[51] Int. Cl.[3] ..... B42F 1/02; G09F 3/16

[52] U.S. Cl. ..... 24/67 R; 24/67.3; 24/67.9; 24/67.11; 40/11 A; 40/23 A

[58] Field of Search ..... 24/67.9, 67 R, 67.3, 24/67.7, 67.11, 67 P, 215, 217 W, DIG. 8, DIG. 9; 40/11 R, 11 A, 23 A; D19/65

[56] References Cited

U.S. PATENT DOCUMENTS

| | | | |
|---|---|---|---|
| 1,273,721 | 7/1918 | Benway | 40/11 A |
| 1,476,420 | 12/1923 | Romig | 24/67.9 |
| 1,783,484 | 12/1930 | Ross | 24/67.9 |
| 2,038,029 | 4/1936 | Doebert | 40/11 A |
| 2,055,152 | 9/1936 | Larson | 40/23 A |
| 2,186,508 | 1/1940 | Tremmel | 40/23 A |
| 2,218,438 | 10/1940 | Robinson | 40/11 A |
| 2,510,508 | 6/1950 | Mayer | 24/67.11 |
| 2,665,463 | 1/1954 | Aurynger | 24/67.11 |
| 2,781,566 | 2/1957 | Hammer | 24/67.9 |
| 2,827,719 | 3/1958 | Nairn | 24/67 R |
| 2,938,252 | 5/1960 | Scheemaeker | 40/23 A |
| 3,083,425 | 4/1963 | Dinnerly, Jr. | 24/67.9 |
| 3,123,924 | 3/1964 | Roberts | 40/11 A |
| 3,132,391 | 5/1964 | Steensland | 24/67 R |
| 3,225,469 | 12/1965 | Chase | 24/67.9 |
| 3,290,810 | 12/1966 | Morena | 40/23 A |
| 3,408,700 | 11/1968 | Chase | 24/67.3 |
| 3,604,067 | 9/1971 | Brown | 24/67 R |
| 3,913,181 | 10/1975 | Walker | D19/65 |
| 4,011,673 | 3/1977 | Levine | 24/67.9 |
| 4,148,114 | 4/1979 | Wier | 24/67.3 |

FOREIGN PATENT DOCUMENTS

| | | | |
|---|---|---|---|
| 2419222 | 10/1975 | Fed. Rep. of Germany | 24/67.9 |
| 317844 | 9/1902 | France | 24/261 |
| 1175696 | 3/1959 | France | D19/65 |
| 1489764 | 7/1967 | France | 24/67.9 |
| 357374 | 11/1961 | Switzerland | 24/67.9 |
| 930491 | 7/1963 | United Kingdom | 40/23 A |

*Primary Examiner*—Victor N. Sakran
*Attorney, Agent, or Firm*—Howard Alan Taishoff

[57] ABSTRACT

A clip to grip paper is adapted to carry advertising indicia. The clip comprises two cooperating gripping jaws. One or both of the jaws is formed with a thin planar land such that the land and jaw are formed as a single piece thereby monolithically to define a plate-like clamping plane. A resilient element maintains the jaws in a given alignment and causes the jaws to exert a clamping pressure. Each planar face of the plate-like clamping plane provides a means on which the advertising indicia is placed.

15 Claims, 12 Drawing Figures

PAPER CLIP

This invention relates to paper clips, and more particularly, the invention relates to a planar clip having one or both jaws formed as a monolithic flat to carry advertising indicia.

Paper clips come in a myriad of constructions. Generally, in its most ubiquitous form, the clip is a wire device formed of internesting elongate wire loops. Because this clip is used so extensively, it would seem desirable to include some means on the clip to convey advertising. However, because the aforementioned wire clip is an ultra low cost item, the means by which the advertising is displayed must also be low in cost. Then, too, to be successful, the means used to carry or display the advertising indicia must remain on the clip in all situations, and it must not interfere with fastening action.

The prior art shows numerous devices that can be used to convey advertising indicia and that can be applied to paper clips. Generally, such prior devices are discrete assemblies that must be attached or clipped onto the clip, and thus can be displaced and lost. Moreover, most of these devices appear to cost more than the clip itself.

The present invention overcomes the problems outlined above. In general, the paper clip of the present invention comprises a pair of cooperating jaws. One or both of these jaws is formed as a thin plate-like member. The plate-like jaw defines a monolithic gripping plane or planar flat that is generally of elongate configuration. Put another way, and in one embodiment, the planar flat and jaw are formed from a single piece thereby monolithically to define a plate-like clamping plane. A resilient biasing element or section, disposed in the plane of the clip, maintains the jaws in a given alignment and causes the jaws to exert a clamping pressure. In one embodiment of the present invention, the gripping plane or flat comprises the entire jaw, and, in another embodiment, the flat comprises only a portion of the jaw. In either case, advertising indicia can be placed on either planar surface of the flat. The planar nature of the gripping plane of the present invention acts to increase the fastening action of same when compared to a conventional wire jaw, and the inventive jaw tends to reduce localized deformations of the paper when compared to such conventional jaws.

It is therefore an object of the present invention to provide a paper clip that is low in cost and that can be used to display advertising indicia.

It is another object of the present invention to provide a paper clip having means with which advertising can be displayed, but wherein such means will not interfere with clip operation.

It is a further object of the present invention to provide a paper clip having means with which advertising indicia can be displayed, and that is readily adapted to fabrication with conventional wire clips.

It is another object of the present invention to provide a paper clip wherein one or both of the gripping jaws are monolithically formed as a thin plate-like member or flat, and wherein this member provides a relatively large surface area with which to grip the paper.

It is a further object of the present invention to provide a paper clip having one or both jaws formed with a thin planar portion, and wherein such planar portion and jaw are formed from a single piece thereby monolithically to define a plate-like clamping plane.

Other objects and features of the present invention will become apparent from the following detailed description considered in connection with the accompanying drawings. It is to be understood, however, that the drawings are designed for purposes of illustration only, and not as a definition of the limits of the invention for which reference should be made to the appending claims.

In the drawings, wherein the same reference numeral denotes the same element throughout the several views.

Figure 10:
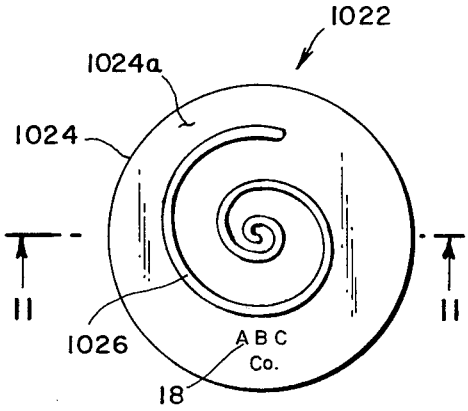
FIG. 10 is another embodiment of a clip constructed according to the present invention, the clip is, so to speak, of reversed construction when compared to FIGS. 4 and 5, that is, the coil spirals radially inwardly along a path that has a convoluted center-directed convergence.
Figure 11:
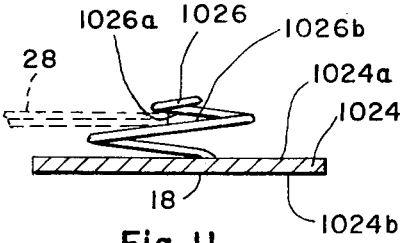
Figure 12:
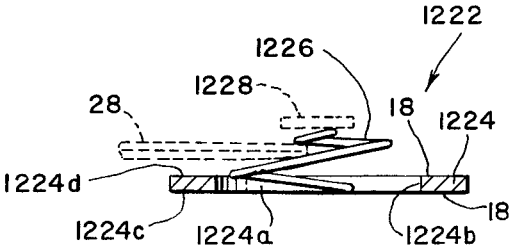

FIG. 11 is a sectional view taken along the line 10—10 of FIG. 10 and looking in the direction of the arrows, for purposes of clarity the coil remains viewed in elevation, coil sections are spread slightly along an imagined longitudinal axis, and they are about to engage the papers to be fastened; and, FIG. 12 is a sectional view similar to FIG. 11 showing a modified form of the clip seen in FIGS. 10 and 11.

Figure 1:
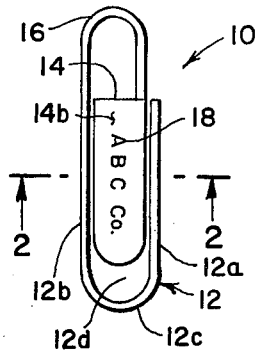
FIG. 1 is a plan view of one embodiment of a clip constructed according to the present invention showing the inventive gripping plane comprising one jaw of a conventional wire clip.
Figure 2:
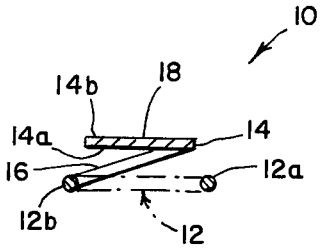
FIG. 2 is a transverse sectional view taken along the line 2—2 of FIG. 1 and looking in the direction of the arrows to show the monolithic or one piece construction of a gripping jaw, for the purposes of clarity the jaws are separated slightly.

In detail now and referring to the drawings, FIGS. 1 and 2 show one embodiment of the present invention. The clip, indicated generally by reference numeral 10, is defined by a pair of cooperating internesting gripping jaws 12 and 14. In the embodiment shown, the outer or relatively larger jaw 12 is formed of a single length of wire that, in plan view, has one end that is bent or formed into an elongate U-shaped configuration. Jaw 12 is thus formed with parallel opposed longitudinal sides 12*a* and 12*b* that are connected by a leading curved portion 12*c*. With this construction, jaw 12 substantially encloses a planar void 12*d*, as shown. The inner or relatively smaller jaw 14 is, in plan view, generally elongate or, more or less, of U-shaped configuration. Jaw 14 is of thin plate-like planar construction and, as such, is defined by two planar surfaces, namely, surface 14*a* and surface 14*b*. Planar jaw or flat 14 is of monolithic unitary construction or, put another way, cast or formed as a single piece, with the planar surfaces thereof extending from one respective perimetric longitudinal edge of the jaw to the other. A connecting U-shaped or bight section 16, preferably of appropriate temper, is, on one end, attached to and is integral with what is shown as a transverse or shorter edge of jaw 14. The other end of U-shaped element 16 is in actuality, an extension of side 12*b*, and is thus formed therewith, as shown. Resilient connecting section 16 is disposed in the plane of clip 10, more or less, and it orients jaws 12 and 14 so that the same align generally longitudinally, with the latter jaw nesting in the planar void of the former. Thus, when the clip is not being used, jaw 12 accommodates jaw 14 so that both jaws lie in a common plane. Moreover, bight section or extension 16 is adapted to exert a clamping pressure when the jaws are separated or skewed slightly during operation of the invention which will be described below.

Advertising indicia 18 can be placed on either one of the two surfaces of gripping plane 14. This can be accomplished in a variety of ways. For example, advertising indicia 18 can be embossed on either or both surfaces 14*a* and 14*b* by stamping or molding. Or, indicia 18 can be placed on these surfaces by printing, silk-screening, and like processes.

Operation and use of the embodiment of FIGS. 1 and 2 is straight-forward and needs little discussion. Suffice it to say, however, that the papers to be fastened are inserted between the separated or slightly skewed jaws 12 and 14 to be held clampingly therebetween by the compressive action of the jaws. Depending on the direction of separation of one jaw relative to the other, one surface of jaw 14 will be placed on the outside of the paper, carrying with it advertising indicia 18. It will be apparent, too, that when compared to conventional wire clips, either planar face presented by jaw or gripping plane 14 provides for an increase in the gripping power of the clip. And, the planar face or surface presented by this jaw acts to distribute the compressive load thereof over a greater area and this tends to minimize localized deformations of the paper.

In the embodiment shown in FIGS. 1 and 2, the relatively smaller jaw, jaw 14, is shown as being of monolithic plate-like construction. However, it is to be understood clearly that the relatively larger jaw, jaw 12, can be formed as the monolithic plate-like gripping plane, and the smaller jaw, jaw 14, can be of open wire construction. Within the disclosure of this invention, this is merely a matter of choice. However, when the relatively larger jaw is made plate-like and thus defines a monolithic or single piece gripping plane, and the other smaller jaw is of open wire form, the geometry of this configuration will not permit the jaws to interfit and occupy a common plane. Instead, wire section or bight element 16 will cause the jaws to overlie, so to speak, such that the facing surface of the larger jaw or gripping plane will be in pressured parallel engaging contact with facing perimetric regions of the wire that defines the smaller jaw. Indeed, as will be disclosed in the immediately following embodiment, both jaws can be of plate-like monolithic construction.

Figure 3:
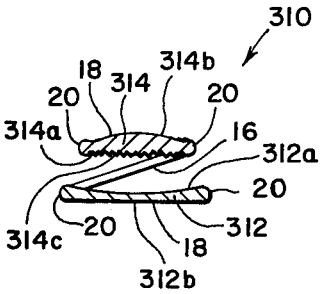
FIG. 3 is a view similar to FIG. 2 showing a modified form of the inventive clip, in FIG. 2 the clip of FIG. 1 is shown with each jaw constructed as a thin monolithic gripping plane.

Turning now to FIG. 3 there is shown, in cross-section, a modified form of the clip shown in FIG. 1. In FIG. 3 each jaw of the clip is comprised of a monolithic plate-like gripping plane that, in plan view, has an outline that resembles a corresponding jaw of FIG. 1. Being more specific, the clip, indicated generally by reference numeral 310, is comprised of a relatively larger monolithic plate-like clamping jaw 312, and a relatively smaller monolithic plate-like clamping jaw 314. Each one of these jaws or gripping planes is defined by a pair of rod-like parallel spaced perimeter-defining longitudinal regions 20 that are monolithically formed with an associated plate-like gripping plane 312 and 314, as shown. Thus, owing to the single piece construction of each jaw 312 and 314, each planar portion of a given jaw and associated perimeter-defining regions 20 are formed from a single piece thereby monolithically to define a respective clamping plane. Each gripping or clamping plane is further defined by respective inboard substantially planar surfaces 312*a* and 314*a*, and a respective outboard surface 312*b* and 314*b*. As described with reference to FIGS. 1 and 2, a connecting U-shaped or bight section 16, preferably of appropriate temper, is connected to a corresponding edge of a respective gripping plane so that the planes align generally longitudinally. Moreover, bight section or element 16 places the respective inboard or opposed surfaces of each jaw in pressured parallel-engaging contact. It will be observed that gripping plane 312 has a slight center directed taper and bows outwardly relatively to the plane defined by rod-like perimeter defining regions 20. That side of gripping plane 314 that immediately faces gripping plane 312, that is, surface 314*a*, is generally flat whereas the outwardly facing side of plane 314, that is, surface 314*b*, bows outwardly relatively to the plane defined by its rod-like perimeter-defining regions 20. A plurality of minute surface discontinuities 314*c* can be formed on inboard surface 314*a* of plane 314 to roughen or texture the last-mentioned surface and thereby increase the gripping power of clip 310. Advertising indicia 18 can be placed on outboard surfaces 312*b* and 314*b* of respective gripping planes 312 and 314, as shown.

Operation and use of the clip of FIG. 3 is straight-forward and, more or less similar to the use and operation described with reference to FIGS. 1 and 2. However, it will be apparent that, when not in use, jaws 312 and 314 do not interfit but rest in back-to-back pressure engagement. Or, put another way, the inboard opposed surfaces of each jaw are in pressured parallel-engaging contact. The roughened texture afforded by surface discontinuities 314*c* add to the overall fastening action of clip 310.

Figure 4:
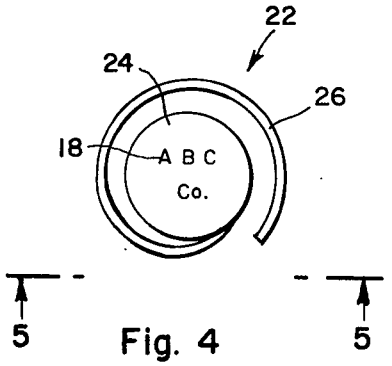
FIG. 4 is a plan view of another embodiment of a wire clip constructed according to the present invention, the clip is, for the most part, in the form of a coil or spiral with a planar flat seen comprising the central portion thereof.
Figure 5:
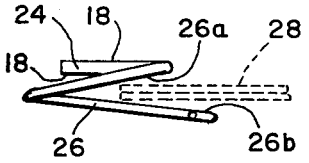
FIG. 5 is a view taken along the line 5—5 of FIG. 4 and looking in the direction of the arrows, for purposes of clarity the coil sections are spread slightly relative to an imagined longitudinal axis, and they are about to engage the papers to be fastened.

Turning now to FIGS. 4 and 5 there is shown another embodiment of a clip constructed according to the present invention. The clip, indicated generally be reference numeral 22, is defined by a central plate-like gripping plane or planar land 24 that is, in plan view, generally circular. A spirally wound, appropriately tempered, internesting planar coil 26 is, on one end, attached to the rim of land 24, while the other end of coil 26 is free. As can be seen in FIG. 4, coil 26 spirals radially outwardly from and around the rim of central planar disc 24 and is, normally, in the plane thereof. Hence, when not in use, coil 26 is, more or less, disposed in the plane of disc 24. Advertising indicia 18 can be placed on either or both planar sides of disc 24.

Operation and use of the clip of FIGS. 4 and 5 is straight-forward. Sections of coil 26 are displaced in a direction orthogonal to the plane of disc 24 thereby to spread adjacent coil sections or coil-planes along an imagined longitudinal axis. The papers to be fastened, papers 28 seen edgewise and in phantom in FIG. 5, are, in one case, inserted between the slightly spread contiguous interfitting coil surfaces of spirally formed element 26. It will be apparent, too, that opposed contiguous perimetric coil surfaces **26*a* and 26*b* compressingly engage papers 28 while orienting advertising indicia 18 in full view. In another case, not shown, papers 28 can be inserted between one face of planar land 24 and the immediately adjacent coil section or surface of spirally wound element 26. In this last-mentioned case, the papers would be grasped by compressive action between the one face of land 24** and the aforesaid adjacent coil section.

In the embodiment of FIGS. 4 and 5, the advertising indicia can be placed on both planar sides of land 24, as noted above, to insure that an advertising message would remain in view even if coil 26 were moved "upwardly" relatively to the plane of disc 24. And, while coil element 26 is shown as comprised of spirally wound wire, element 26 can be comprised of spirally wound flat stock. When this is the case, the advertising indicia can be carried on the planar surfaces of this flat stock.

Figure 6:
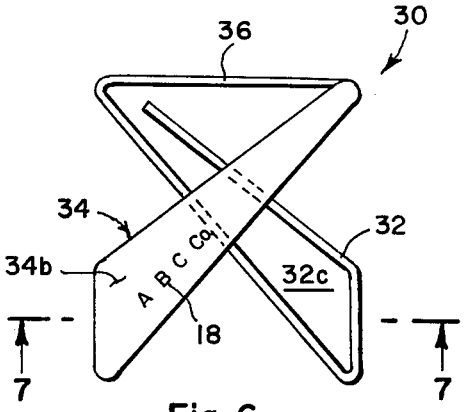
FIG. 6 is a plan view of a further embodiment of a clip constructed according to the present invention showing the inventive gripping flat comprising one jaw of a conventional wire clip.
Figure 7:
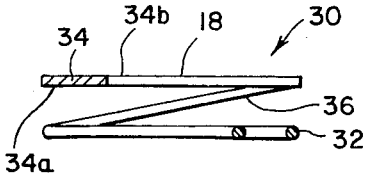
FIG. 7 is a sectional view taken along the line 7—7 of FIG. 6 to show, in detail, the monolithic or single piece construction of the gripping plane or gripping jaw, for purposes of clarity the jaws are separated slightly.

Turning now to FIGS. 6 and 7, there is shown another embodiment of the present invention. A clip, indicated generally by reference numeral 30, is of conventional profile, and thus has a pair of V-shaped gripping jaws or limbs 32 and 34 that are in criss-crossed back-to-back disposition. A length of wire 36, forming what resembles a base, connects an acute end of a respective V-shaped or triangularly formed limb in spaced angulated disposition, as shown. Wire element 36 is tempered appropriately and thereby resiliently biases one limb or jaw against the other. In accordance with the present invention, limb 34 is formed from thin plate-like stock and thus has an inner planar surface **34*a*, and an outer planar surface 34*b*. Hence, limb 34 defines a generally flat gripping plane of monolithic or unitary construction that, in plan view, is of triangular configuration. Hence, limb 34 is cast or formed as a single piece thereby monolithically to define a plate-like clamping plane. Limb 32 is of open wire construction. In actuality, limb or jaw 32 is an extension of wire section 36. The wire comprising or defining limb 32 eventually is bent back upon itself in such manner as to form a V-shaped wire jaw that encloses a planar void 32*c*, as shown. With this construction a portion of the inboard planar surface of jaw 34 is in pressured parallel-engaging contact with a planar portion of jaw 32 along a criss-cross path. Thus, by means element 36, the facing regions of jaws 32 and 34 are adapted to exert a clamping pressure. On the outboard surface 34*b* of V-shaped gripping plane 34, advertising indicia 18** can be placed.

Operation and use of clip 30 is straight-forward. The papers to be fastened are inserted between opposed or facing jaws compressingly to be clamped therebetween. The increased contact area afforded by gripping plane 34 or, more precisely, surface **34*a*, operates to increase the gripping power of clip 30 when compared to clips of conventional design. And, the outboard planar face 34*b* of gripping plane 34 provides a relatively large surface on which advertising indicia 18** can be placed.

In the embodiment of FIGS. 6 and 7, and as noted above, one jaw of the clip is shown as comprised of a monolithic plate-like member while the other jaw is merely of bent wire construction. However, the invention is not to be limited to this design because each jaw can be cast or formed as a monolithic plate-like member.

Figure 8:
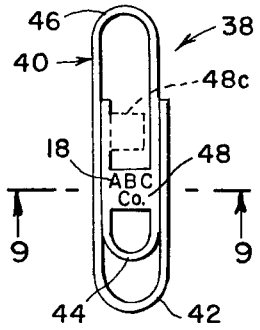
FIG. 8 is a plan view of another embodiment of a clip constructed according to the present invention showing the plate-like planar flat or land monolithically formed with a portion of one jaw of a conventional wire clip.
Figure 9:
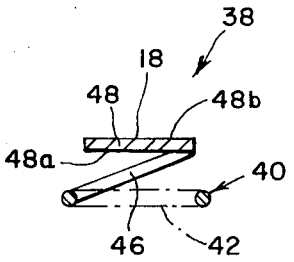
FIG. 9 is a sectional view taken along the line 9—9 of FIG. 8 to reveal, in detail, the one piece construction of the planar flat and jaw.

Turning now to FIGS. 8 and 9, there is shown another embodiment of a clip built according to the present invention. A wire clip, generally indicated by reference numeral 38, is, more or less, of conventional construction. Hence, clip 38 is formed from a single length of wire 40 which is bent to form opposed, longitudinally aligned, internesting elongate U-shaped jaws 42 and 44. Each U-shaped jaw is connected by a resilient curved section or bight portion 46. In accordance with the present invention, a planar land or flat 48 is disposed between the opposed longitudinal wire sections or sides that comprise the longitudinal perimeter of jaw 44. The ends of flat 48 are monolithically formed with the aforesaid parallel opposed longitudinal sides of jaw 44, thus forming a planar bridge, so to speak, between the longitudinal sides of U-shaped jaw 44. Stated another way, flat 48 and jaw 44 are formed from a single piece thereby monolithically to define a plate-like clamping bridge that extends between the longitudinal sides of jaw 44. Flat 48 is defined by one planar surface **48*a*, and another planar surface 48*b* both of which are, more or less, in the plane of jaw 44, as seen in FIG. 9. When comparison is made between FIGS. 1 and 8, it will be noticed that flat 48 is disposed or covers only a portion of the longitudinal length of jaw 44. Advertising indicia can be placed on either planar surface of flat 48**.

Operation and use of clip 40 should be readily apparent, and so needs no discussion here.

In the embodiment of FIGS. 8 and 9, planar land or flat 48 is shown disposed on and monolithically formed with relatively smaller jaw 44. But the invention is not to be so limited because the land can be placed on either jaw, or on both of them. Indeed, the land need not extend between both longitudinal perimetric-defining wire sides of jaw 44 as it is shown in FIGS. 8 and 9, for a land (**48*c*, seen in phantom in FIG. 8) can be monolithically formed with one longitudinal side of jaw 44 in a type of cantilever disposition. Or, the land can be positioned contiguous to the leading or curved section of either jaw, with the flat and leading curved section formed monolithically. In fact, it is within the scope of this invention to position a flat or plate-like member within the void of curved element or bight portion 46**, with the flat and bight portion formed monolithically. Although this last-described position of the flat might interfere with clip operation to some degree.

Turning now to FIGS. 10 and 11 there is shown another embodiment of a clip constructed according to the present invention. The clip, indicated generally by reference numeral 1022, is defined by a monolithic central planar gripping flat or disc 1024 that has an inboard planar face **1024*a* and an outboard planar face 1024*b*. A spirally wound appropriately tempered resilient planar coil 1026 is, on one end, attached to one planar face of disc 1024 preferably near the rim thereof. The other end of coil 1026 is free. As can be seen in FIG. 10, coil 1026 spirals radially inwardly along a path that has a convoluted center-directed convergence. Owing to the planar construction of coil 1026, the free end thereof is normally disposed adjacent to the opposed planar face of disc 1024, that in the embodiment shown, is face 1024***a*. Thus, when not in use, the plane of coil 1026 is, more or less, disposed adjacent to face 1024*a*. Advertising indicia 18 can be placed on either or both planar faces of disc 1024.

Operation and use of the embodiment of FIGS. 10 and 11 is straight-forward and, for the most part, similar to the manner of operation described with reference to FIGS. 4 and 5. Hence, in one case, the papers to be fastened, papers 28, are inserted between opposed, longitudinally displaced coil surfaces 1026*a* and 1026*b* compressingly to be held therebetween. In another case, not shown, papers 28 can be inserted between face 1024*a* of flat 1024 and the immediately adjacent coil section or surface of spirally wound element 1026.

Turning now to FIG. 12 there is shown in cross-section a modified form of the clip seen in FIGS. 10 and 11. A clip, indicated generally by reference numeral 1222, is formed of a washer-like planar central region or disc 1224 having a central aperture 1224*a*. Aperture 1224*a* is defined by an inboard annular rim 1224*b*. Circular disc 1224 has two planar faces 1224*c* and 1224*d*. A spirally wound, appropriately tempered, resilient planar coil 1226, similar to coil 1026, is, on one end, attached to aperture-defining rim 1224*b* of disc 1224. The other end of coil 1226 is free. In plan view, coil 1226 spirals radially inwardly along a path that has a convoluted center directed convergence. Owing to the planar construction of coil 1226, the free end thereof is normally disposed in the planar void of member 1224 that defines aperture 1224*a*. Thus, when not in use, the plane of coil 1226 aligns with, or is in the plane of, disc 1224. Advertising 18 can be placed on either or both planar faces 1224*c* and 1224*d*.

Operation and use of the clip of FIG. 12 is straight-forward, and for the most part, similar to the manner of operation and use discussed with reference to FIGS. 10 and 11. It will be apparent, though, that coil 1226 can move relatively "upwardly" or "downwardly" with respect to member 1224 thereby to place the coil on either one planar side of member 1224, or the other. With this construction, either one of these planar sides can cooperate with coil 1226 to clamp papers 28. Moreover, when comparison is made between FIGS. 11 and 12, it will be seen that in FIG. 12, since the planes of element 1226 and member 1224 align, due to the accommodation of the former in the void of the latter, clip 1222 will have a nested or unused thickness generally no greater than the thickness of member 1224.

In plan view, coil 1226 of FIG. 12 looks like coil 1026 of FIG. 10, although as noted above, the larger diameter end of coil 1226 is attached to inboard rim 1224*b* while the other end of coil 1226 is free. In accordance with the present invention, a planar land or flat 1228, seen in phantom in FIG. 12, can be attached to the aforesaid free end of coil 1226. In plan view, land 1228 would be preferably circular, and in elevation, oriented generally parallel to the plane of washer 1224. Land 1228 would then provide a convenient finger rest that can be used to reposition and rebias spring 1226 if the spring becomes deformed plastically.

In the embodiments of FIGS. 10, 11 and 12 the coil element is shown as comprised of spirally wound wire, but as in earlier described embodiments, the coil element can be comprised of spirally wound flat stock, with the advertising indicia placed on the planar face of this flat stock.

In all of the foregoing embodiments, it is possible to fabricate the clips from metal stock in a single process or stamping. Or, the clips can be fabricated from plastic and made by injection molding or stamping. In fact, it is feasible to fabricate the inventive clips as a composite structure. For example, gripping plane 14 can be fabricated from plastic, and element 16 and jaw 12 can be made of small diameter steel rod or wire.

While only a few embodiments of the present invention have been shown and described, it is to be understood that many changes and modifications can be made hereto without departing from the spirit and scope hereof.

What is claimed is:

1. In a paper clip of the type formed of a single length of wire having opposite end portions bent into a U-shaped configuration to provide two distinct yet cooperating U-shaped gripping jaws, the improvement comprising a planar land disposed within the planar void that defines one of the gripping jaws, said planar land being formed with the respective wire sections defining said one gripping jaw whereby said planar land and jaw are formed from a single piece thereby monolithically to define a thin plate-like clamping plane that substantially fills the void.

2. The improved clip of claim 1, one of the surfaces defining said plate-like clamping plane having a roughened texture to increase the gripping power of the clip.

3. In a paper clip of the type formed from a single length of wire, and wherein the wire is bent to form a pair of cooperating substantially planar gripping jaws such that in plan view the respective wire sections defining each gripping jaw enclose a planar void, the improvement comprising a thin plate-like planar member formed with a portion of a respective wire section forming one of the gripping jaws such that said planar member and respective wire section are formed from a single piece thereby monolithically to define a plate-like clamping plane that is disposed in cantilever disposition on said one jaw, said planar member being defined by two substantially planar surfaces.

4. In a paper clip of the type formed from a single length of wire that is bent upon itself to form a pair of cooperating substantially planar gripping jaws such that in plan view the corresponding wire sections defining each gripping jaw enclose a planar void, the improvement comprising a thin plate-like planar flat formed with a portion of the substantially opposed longitudinal sides that define one of the gripping jaws whereby said plate-like planar flat and said substantially opposed longitudinal sides that define said one gripping jaw are formed from a single piece thereby monolithically to define a planar bridge therebetween, said planar bridge thereby being disposed for only a portion of the longitudinal length of said one gripping jaw and being defined by two substantially planar surfaces on either of which advertising indicia can be placed.

5. A paper clip comprising a thin central planar member defined by a perimetric rim and two substantially planar faces, each of said faces being adapted to carry advertising indicia, a coil spirally wound and of planar configuration, said coil being formed of a single length of appropriately tempered relatively small diameter wire, one end of which is attached to said member, the other end of said coil being free and normally disposed in the plane of said member, said coil being attached to said member such that said coil spirals radially outwardly around said member with the plane of said coil substantially in the plane of said member whereby said free end of said coil is spaced from said perimetric rim, the attachment of said coil to said member being such that portions of said coil are adapted to be resiliently displaced in a direction generally orthogonal to the plane of said member whereby said coil sections and one of said planar faces, as the case may be, form gripping surfaces compressingly to grip the paper.

6. A paper clip comprising a pair of cooperating gripping jaws one of which defines a planar void, a portion of said one gripping jaw being formed with a thin planar flat whereby said planar flat and portion of said one gripping jaw are formed from a single piece thereby monolithically to define a plate-like clamping plane that, substantially, is in the plane of said one gripping jaw, said plate-like clamping plane being defined by two substantially planar faces, and means for maintaining said jaws such that the same are adapted to exert a clamping pressure.

7. The clip of claim 6, said plate-like clamping plane being disposed so as substantially to fill the planar void of said one gripping jaw.

8. The clip of claim 6, one of the planar faces of said plate-like clamping plane being formed with a plurality of surface discontinuities that roughen the same to increase the gripping power of the clip.

9. A paper clip comprising a central planar member defined by two substantially planar faces, a coil spirally wound and of planar configuration, one end of said coil being attached to one face of said member in a manner whereby said one end rises minutely upwardly from the plane of said member such that the other end of said coil spirals radially inwardly along a path that has a convoluted center-directed convergence with the plane of said coil normally adjacent to, albeit spaced from, said one face of said member, portions of said coil being adapted to be resiliently displaced in a direction generally orthogonal to the plane of said member whereby sections of said coil and said one face of said member, as the case may be, form gripping surfaces compressingly to grip the paper.

10. In a paper clip of the type formed from a single length of wire that is bent upon itself to form a pair of cooperating, internesting, elongate, U-shaped gripping jaws each of which defines a U-shaped planar void, and wherein the U-shaped wire jaws are operatively connected by a curved or bight section such that said bight section defines a planar void, the improvement comprising a thin planar flat formed with that portion of the wire that defines said bight section whereby said plate-like planar flat and bight section are formed from a single piece thereby monolithically to define a plate-like land that, substantially, fills the planar void defined by said bight section, said plate-like land being disposed in the plane of the clip and defined by two substantially planar surfaces each of which is adapted to carry advertising indicia.

11. A paper clip comprising a central planar member defined by two substantially planar faces and a generally central aperture communicating between said planar faces, said aperture being defined by an inboard aperture-defining rim, a coil spirally wound and generally of planar configuration, one end of said coil being attached to the aperture-defining inboard rim, the other end of said coil spiralling radially inwardly along a path that has a convaluted center-directed convergence such that said other end of said coil normally resides in the plane of said aperture whereby the respective planes of said coil and member generally align, portions of said coil being adapted to be resiliently displaced in a direction generally orthogonal to the plane of said member whereby sections of said coil and one of said planar faces, as the case may be, form gripping surfaces compressingly to grip the paper.

12. The clip of claim 11, said member, in plan view, being of washer-like configuration.

13. The clip of claim 11, a planar flat fixedly attached to said other end of said coil, said planar flat being dimensioned so as to fit in said aperture and thus provide a finger rest to facilitate the repositioning and rebiasing of said coil.

14. A paper clip comprising a single piece of wire having one end bent into an elongate U-shaped clamping jaw that, in plan view, defines an elongate U-shaped planar void, the other end of said wire piece being bent into a generally U-shaped configuration thereby to define a resilient U-shaped bight section that substantially is in the plane of said U-shaped clamping jaw, and a planar flat formed as a single piece that, in plan view, is of elongate configuration and sized so as to fit in said U-shaped planar void, said planar flat operatively being connected to said bight section such that the same orients said planar flat in said U-shaped planar void whereby said planar flat and U-shaped clamping jaw substantially nest in a common plane and substantially align longitudinally, said planar flat defining a monolithic clamping plane that, in cooperation with said U-shaped clamping jaw, is adapted to exert a clamping pressure.

15. A clip to grip paper comprising a pair of gripping jaws, each of said gripping jaws, in plan view, being of triangular configuration, one of said jaws being of bent wire construction thereby delineating a triangularly shaped planar void, the other one of said jaws being formed as a thin plate-like member thereby to define a monolithic clamping plane, said monolithic clamping plane having two substantially planar faces, and means for resiliently maintaining said jaws in criss-cross back-to-back angulated disposition whereby said jaws are connected to the clip at a respective acute end such that one of said planar faces and the facing perimetric regions of said bent wire are in pressured parallel-engaging contact and are adapted to exert a clamping pressure.

* * * * *